US006537098B2

(12) United States Patent
Kashiyama et al.

(10) Patent No.: US 6,537,098 B2
(45) Date of Patent: Mar. 25, 2003

(54) CONNECTOR FITTING CONSTRUCTION USING RESILIENT FORCE

(75) Inventors: Motohisa Kashiyama, Shizuoka (JP); Takanori Yamawaki, Shizuoka (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 09/910,834

(22) Filed: Jul. 24, 2001

(65) Prior Publication Data

US 2002/0025711 A1 Feb. 28, 2002

(30) Foreign Application Priority Data

Jul. 24, 2000 (JP) ..... 2000-222522
Jul. 24, 2000 (JP) ..... 2000-222596

(51) Int. Cl.[7] ..... H01R 13/627
(52) U.S. Cl. ..... 439/352
(58) Field of Search ..... 439/352, 350, 439/351, 489, 490

(56) References Cited

U.S. PATENT DOCUMENTS 6,095,843 A * 8/2000 Kaneko et al. ..... 439/352

FOREIGN PATENT DOCUMENTS

| | | |
|---|---|---|
| EP | 0896396 A2 | 2/1999 |
| FR | 1299718 A | 7/1962 |
| JP | 11-149959 | 6/1999 |

OTHER PUBLICATIONS

Patent Abstract of Japan 11–149959, Jun. 2, 1999.
European Search Report Nov. 18, 2002.

* cited by examiner

*Primary Examiner*—Javaid Nasri
(74) *Attorney, Agent, or Firm*—Sughrue Mion, PLLC

(57) ABSTRACT

In a connector fitting structure, a first retaining portion is formed on an inner surface in a slider receiving portion formed in a housing of the male connector a second retaining portion is formed at an distal end of a first engagement arm of a slider. Slanting surfaces are formed on those portions of the first and second retaining portions so that said second retaining portion smoothly engages with said first retaining portion by operating an operating portion, when the fitted condition of said male and female connectors is cancelled. Further, the slider includes first and second slide members and compression springs and is mounted in the slider receiving portion. Retaining projections are formed on opposite sides of the first slide member, and slider retaining portions are formed on side surfaces of the slider receiving portion. Therefore, the retaining projections are retained by the slider retaining portions.

5 Claims, 12 Drawing Sheets

CONNECTOR FITTING CONSTRUCTION USING RESILIENT FORCE

BACKGROUND OF THE INVENTION

1. Field of the Invention

This invention relates to a connector fitting structure in which a half-fitted condition is positively prevented by a resilient force of a resilient member mounted on at least one of a pair of male and female connectors to be fittingly connected together, and the connector can be positively locked to the mating connector in a fitted manner.

The present invention is based on Japanese patent applications No. 2000-222522 and No. 2000-222596 which are incorporated herein by reference.

2. Description of the Related Art

Usually, many electronic equipments for effecting various controls are mounted on a vehicle such as an automobile, and therefore many wire harnesses and flat cables have been used. There have been used male and female connectors of various constructions which have a waterproof function since they are used in a severe environment in which vibrations and submergence are encountered, and besides these connectors are so constructed as to be easily connected to and disconnected from a wire harness or the like in view of an assembling process and the maintenance.

Next, one example of conventional connector fitting structures will be described with reference to FIGS. 10 to 11.

As shown in FIG. 10, a male connector (one connector) 50 of the connector fitting structure includes an inner housing 52, which has terminal receiving chambers for respectively receiving a predetermined number of socket contacts, and is open to the front side thereof, and an outer housing 51 which has a slider (slide lock member) 60 (described later) slidably mounted at an upper portion thereof, and forms a hood portion covering the outer periphery of the inner housing 52.

The outer housing 51 is provided to form a slider receiving portion 53 for receiving the slider 60, and guide grooves 55 for respectively guiding opposite side portions of the slider 60 are formed respectively in inner surfaces of opposite side walls of the housing. Within the slider receiving portion 53, a lock arm 56, having an elastic free front end portion, is formed integrally on the inner housing 52 along the axis in a fitting direction. Between the lock arm 56 and the inner surfaces of the housing, there is provided inner wall surfaces 53*a*.

A pair of housing locks 58 for retaining engagement with engagement projections 83 (see FIG. 11) on a mating housing (described later) are formed on an upper surface of the lock arm 56 at the distal end thereof, and a pressing portion 59, which is operated when canceling the fitted condition, is formed on a central portion of the lock arm. An insertion space 56a for allowing the insertion of a pressing rib 82 on a female connector 80 (described later) is formed in a front portion of the lock arm 56 including the housing locks 58.

A pair of retaining arms 57 for temporarily preventing the rearward movement of the slider 60 are provided at a rear portion of the slider receiving portion 53 along the axis in the fitting direction, and each of these retaining arms has a retaining projection formed at its elastic free rear end portion.

The slider 60 comprises a first slide member 61 for sliding movement in the slider receiving portion 53 while guided by the guide grooves 55, a second slide member 66 engaged with a rear portion of the first slide member 61, and compression springs (resilient members) 73 held in the second slide member 66.

The first slide member 61 includes a pair of rearwardly-extending stopper arm portions 63 and 63, which are engaged respectively with one ends of the compression springs 73, and an interconnecting portion 64 interconnecting these arm portions. An abutment portion 65, against which the pressing rib 82 on the female connector 30, can abut, is formed in the lower side of the interconnecting portion 64.

A pair of slide grooves 62 and 62 for allowing the movement of engagement arm portions (described later) of the second slide member 66 are formed in opposite ends of the interconnecting portion 64, respectively.

The second slide member 66 is slidably fitted at its outer side portions in the guide grooves 55, and has retaining portions 67 which extend forwardly from a lower portion of a front end thereof, and respectively retain the housing locks 58, formed at the distal end of the lock arm 56, when these housing locks are displaced. A passage notch 67*a* for allowing the passage of the pressing rib 82 of the female connector 80 (described later) is formed between front ends of the retaining portions 67.

An elastic operating portion 69, which is operated when canceling the fitted condition, is formed at an upper portion of the second slide member 66 at a widthwise-central portion thereof, and this operating portion 69 covers the pressing portion 59 of the lock arm 56 in overlying relation thereto when the slider is inserted into the slider receiving portion 53.

The pair of elastic engagement arm portions 68 and 68 for retaining engagement with the stopper arm portions 63 of the first slide member 61 are provided respectively at the opposite side portions of the second slide member 66 at a lower portion thereof.

Spring receiving chambers 71 for respectively receiving and holding the compression springs 73 are formed respectively in inner surfaces of the opposite side walls. of the second slide member 66. The compression springs 73 are inserted respectively into the spring receiving chambers 71, and the engagement arm portions 68 are brought into engagement with the stopper arm portions 63, respectively, and by doing so, the first slide member 61 and the second slide member 66 are combined together in a generally unitary manner.

As shown in FIG. 11, the female connector (the other connector) 80 has a housing insertion port 84 open to the front side thereof, and a predetermined number of pin contacts 85 project into the interior of this insertion port in a fitting direction. The pressing rib 82 for abutment against the abutment portion; 65 of the first slide member 61 is formed upright on a central portion of an outer surface of the housing 81. The pair of engagement projections 83 and 83 for elastically deforming the lock arm 56 and for engagement with the housing locks 58 are formed respectively on opposite side surfaces of the pressing rib 82.

Next, the operation for fitting the male and female connectors of the above construction together will be described.

First, the slider 60, shown in FIG. 10, is assembled. For assembling the slider 60, the pair of compression springs 73 are inserted respectively into the spring receiving chambers 71 in the second slide member 66, and then the stopper arm portions 63 and 63 of the first slide member 61 are inserted into the spring receiving chambers 71, respectively. Then, the engagement arm portions 68 and 68 are engaged respectively with the stopper arm portions 63 and 63, thereby combining the first and second slide members 61 and 66 together into a unitary form, with the compression springs 73 held respectively in the spring receiving chambers 71.

For mounting the slider 60 on the male connector 50, the slider 60 is pushed into the slider receiving portion 53 from the front side of the male connector 50. At this time, the outer side portions of the stopper arm portions 63 of the first slide member 61, the opposite end portions of the interconnecting portion 64, and the opposite side portions of the second slide member 66 are fitted into the guide grooves 55, and the rear end of the second slide member 66 is brought into abutting engagement with the retaining arms 57 whereupon the mounting of the slider 60 is completed. In this condition, the slider 60 is temporarily retained by the retaining arms 57, but a compressive force is not exerted in the compression springs 73. Here, description of the insertion of the contacts into the terminal receiving chambers in the male connector 50 is omitted.

Next, the operation for fitting the male and female connectors 50 and 80 together will be described.

The inner housing 52 of the male connector 50 and the housing insertion port 84 of the female connector 80 are arranged in facing relation to each other as shown in FIG. 11, and in this condition the operation for fitting the male and female connectors together is started in such a manner that the outer housing 51 of the male connector 50 is fitted on the housing 81 of the female connector 80. At this time, the pressing rib 82 of the female connector 80 fits into the passage notch 67*a* (see FIG. 10) in the second slide member 66, and the front end of the pressing rib 82 abuts against the abutment portion 65 of the first slide member 61 as shown in FIG. 12.

When the fitting operation further proceeds, the pressing rib 82 of the female connector 80, while pushing the first slide member 61, is inserted into the insertion space 56*a* (see FIG. 10) in the lock arm 56 of the male connector 50. At this time, the engagement projections 83, formed at the front end of the pressing rib 82, are brought into sliding contact with slanting surfaces of the housing locks 58, formed at the distal end of the lock arm 56, so that the distal end portion of the lock arm 56 is displaced toward the housing 81 of the female connector 80.

As a result, the distal ends of the housing locks 58 are engaged respectively with the retaining portions 67 of the second slide member 66, so that the second slide member 66 can not slide together with the first slide member 61.

When the fitting operation further proceeds, the first slide member 61 is pushed and moved rearward by the pressing rib 82. At this time, the engagement arm portions 68 of the second slide member 66 are allowed to be introduced respectively into the slide grooves 62 formed respectively in the opposite side portions of the first slide member 61. Thus, the first slide member 61 is moved while the second slide member 66 is stopped, and therefore the compression springs 73 in the second slide member 66 are compressed, so that a resilient restoring force is produced.

If the fitting operation is stopped in a half-fitted condition in which the housing locks 58 of the male connector 50 are not completely engaged respectively with the engagement projections 83 of the female connector 80, the first slide member 61 is pushed back in a disengaging direction (opposite to the fitting direction) by the resilient force of the compression springs 73. As a result, the female connector 80 is pushed back through the pressing rib 82 abutted against the abutment portion 65 of the first slide member 61, and therefore the half-fitted condition can be easily detected.

Then, when the fitting operation further proceeds against the bias of the compression springs 73, the engagement projections 83 of the female connector 80 slide respectively past the housing locks 58 formed at the distal end of the lock arm 56, so that the lock arm is elastically restored. As a result, the engagement of the distal end of each housing lock 58 with the retaining portion 67, formed at the distal end of the second slide member 66, is canceled, so that the housing lock 58 is engaged with the rear end of the engagement projection 83, as shown in FIG. 12. Therefore, the male connector 50 and the female connector 80 are completely fitted together, and contacts 54 in the male connector are electrically connected respectively to contacts 85 in the female connector.

At this time, the maximum compressive force, exerted in the compression springs 73, is released as a result of cancellation of the engagement of each housing lock 58 with the retaining portion 67, and the second slide member 66 is moved rearward against the retaining force of the elastically-deformable retaining arms 57, and is brought into an initial position relative to the first slide member 61.

At this time, the operating portion (69, so far covering the pressing portion 59 on the lock arm 56, is moved rearward, so that the pressing portion 59 is exposed upwardly.

Also, the retaining portions 67 of the second slide member 66 are moved into a flexure space for the distal end portion of the lock arm 56, so that the lock arm 56 is locked against elastic deformation. Therefore, the completely-fitted condition of the male and female connectors 50 and 80 can be easily detected through a feeling, obtained upon engagement of each housing lock 58 with the engagement projection 83, and also through the exposure of the pressing portion 59.

For canceling the above completely-fitted condition, the operating portion 69 of the second slide member 66 is moved forward by the finger or other against the bias of the compression springs 73 to a position where this operating portion 69 covers the pressing portion 59 of the lock arm 56, as shown in FIG. 13. Then, when the operating portion 69 is pressed down to depress the pressing portion 59, the housing locks 58 of the lock arm 56 are displaced downward, so that the engagement of the housing locks 58 with the engagement projections 83 is canceled. At this time, the first slide member 61 is pushed forward by the resilient force of the compressed compression springs 73.

As a result, the female connector 80 is pushed back in the disengaging direction through the pressing rib 82 of the female connector 80 abutted against the abutment portion 65 of the first slide member 61. Therefore, the disengaging force, required for disengaging the connectors from each other, can be reduced, and the efficiency of the disengaging operation can be enhanced.

In the above conventional half-fitting prevention connector, however, the following problems have been encountered during the fitting operation and the fitting-cancellation operation.

First, with respect to the problem encountered during the fitting operation, the rear end of the second slide member 66 is extended, and therefore when the completely-fitted condition is achieved as shown in FIG. 12, the rear end of the second slide member 66 strikes hard against the inner wall surfaces 53*a* (see FIG. 11) of the slider receiving portion 53. Therefore, there has been a fear that cracking and chipping develop in the inner wall surfaces 53*a*.

Next, with respect to the problem encountered during the fitting-cancellation operation, for effecting this fitting-cancellation operation, first, the slider 60 must be drawn in a direction of arrow X, and then must be pressed in a direction of arrow Y. Namely, the two-step operation is required, and there has been a fear that the distal end of the slider 60, when excessively pressed down, is broken.

And besides, during the cancellation operation, the pressing portion 59 descends in sliding contact with the side surface of the first slide member 61, and therefore the enhanced operability for operating the slider in the direction of arrow Y has been prevented.

Further, in the above conventional half-fitting prevention connector, the following problems have been encountered when the slider 60 is mounted in the slider receiving portion 53.

Namely, the first slide member 61 of the slider 60 is not retained on the housing 51, and hence is not retained on the slider receiving portion 53, and the compression springs 73 do not urge the first slide member 61. Therefore, a clearance, that is, a dimensional play, develops between the first slide member 61 and other members, and this has been the cause for the production of noises.

In addition, if the first slide member 61 is urged by the compression springs 73 in order to prevent the production of such noises, there has been encountered a problem that the first slide member 61 projects from the front end of the housing 51.

SUMMARY OF THE INVENTION

With the above problems in view, it is an object of the present invention to provide a connector fitting structure in which a half-fitted condition is positively prevented when a pair of male and female connectors are fittingly connected together, and an enhanced operability for the fitting-cancellation operation, as well as the prevention of breakage, can be achieved.

Further, it is also an object of the present invention to provide a connector fitting structure in which a slider is mounted in a slider receiving chamber, formed in one of a pair of male and female connectors, without rattling.

The above problems to be dealt with by the present invention have been solved by connector fitting structures recited in the following Paragraphs 1) to 4):

1) A connector fitting structure comprising: a first connector having an inner housing opening to a front side thereof including a lock arm, and an outer housing covering the inner housing and provided with a slider receiving portion for slidably receiving a slider therein; the slider including a first slide member for reciprocally sliding within the first connector in a connector fitting direction, a second slide member engaged with a rear portion of the first slide member, and an resilient member for urging the first and second slide members away from each other; a second connector fitted to the first connector and having an engagement projection for abutment against one end of the slider and for deforming the lock arm; a first retaining portion projecting downwardly from an inner surface of the outer housing; and a second retaining portion provided at a distal end of a first engagement arm formed on the second slide member; wherein the first and second retaining portions are engaged with each other before fitting of the first and second connectors and after canceling the fitted state of the first and second connectors, and disengaged from each other at the time of fitting of the first and second connectors; and wherein slanting surfaces are provided both on the first and second retaining portions, so that the second retaining portion smoothly engages with the first retaining portion by a sliding movement of the second sliding member in one direction, when the fitted condition of the first and second connectors is cancelled.

In the connector fitting structure of the above construction, when the second retaining portion, formed at the end of each first engagement arm, slides over the first retaining portion, formed at the one end of the inner surface facing the slider receiving portion, and is engaged with this first retaining portion at the time of canceling the fitted condition of the first and second connectors (therefore a pair of male and female connectors), this engagement can be effected smoothly since the slanting surfaces are formed respectively on those portions of the first and second retaining portions which can be brought into sliding contact with each other.

2) A connector fitting structure comprising: a first connector having an inner housing opening to a front side thereof including a lock arm, and an outer housing covering the inner housing and provided with a slider receiving portion for slidably receiving a slider therein; the slider including a first slide member for reciprocally sliding within the first connector in a connector fitting direction, a second slide member engaged with a rear portion of the first slide member, and an resilient member for urging the first and second slide members away from each other; a second connector fitted to the first connector and having an engagement projection for abutment against one end of the slider and for deforming the lock arm; a first retaining portion projecting downwardly from an inner surface of the outer housing; a second retaining portion provided at a distal end of a first engagement arm formed on the second slide member; and an operating portion integrally formed on the first engagement arm for operating to slide the second slide member in the slider receiving portion at the time of canceling the fitted state of the first and second connectors; wherein the first and second retaining portions are engaged with each other before fitting of the first and second connectors and after canceling the fitted state of the first and second connectors, and disengaged from each other at the time of fitting of the first and second connectors; and wherein the operating portion is abutted against an end of the first retaining portion, thereby detecting the engagement between the first and second retaining portions at the time of canceling the fitted state of the first and second connectors.

In the connector fitting structure of the above construction, at the time of canceling the fitted condition of the male and female connectors, one end of the operating portion for sliding the second slide member abuts against the end of the first retaining portion formed at the one end of the inner surface facing the slider receiving portion, and the cancellation of the fitted condition can be detected by whether or not this abutment has occurred, and therefore the operability for the fitting-cancellation operation is greatly enhanced.

3) A connector fitting structure comprising: a first connector having an inner housing opening to a front side thereof including a lock arm, and an outer housing covering the inner housing and provided with a slider receiving portion for slidably receiving a slider therein; the slider including a first slide member for reciprocally sliding within the first connector in a connector fitting direction, a second slide member engaged with a rear portion of the first slide member, and an resilient member for urging the first and second slide members away from each other; a second connector fitted to the first connector and having an engagement projection for abutment against one end of the slider and for deforming the lock arm; a first retaining portion projecting downwardly from an inner surface of the outer housing; a second retaining portion provided at a distal end of a first engagement arm formed on the second slide member; and an operating portion integrally formed on the first engagement arm for operating to slide the second slide member in the slider receiving portion at the time of canceling the fitted state of the first and second connectors; wherein a tapering surface is formed on an upper surface of the second slide member, facing the slider receiving portion at the time of fitting of the first and second connectors, so that an area of contact between the second slide member and the slider receiving portion at the time of fitting of the first and second connectors is reduced.

In the connector fitting structure of the above construction, at the time of fitting the male and female connectors together, the second slide member is urged toward the rear end of the slider receiving portion. However, the tapering surface is formed at the rear end of the operating portion opposed to a corner portion at the rear end of the slider receiving portion, and therefore the rear end of the operating portion will not abut against the corner portion of the slider receiving portion over an entire area thereof, thereby preventing cracking and chipping.

4) A connector fitting structure comprising: a first connector having an inner housing opening to a front side thereof including a lock arm, and an outer housing covering the inner housing and provided with a slider receiving portion for slidably receiving a slider therein; the slider including a first slide member for reciprocally sliding within the first connector in a connector fitting direction, a second slide member engaged with a rear portion of the first slide member, and an resilient member for urging the first and second slide members away from each other; a second connector fitted to the first connector and having an engagement projection for abutment against one end of the slider and for deforming the lock arm; a first retaining portion projecting downwardly from an inner surface of the outer housing; a second retaining portion provided at a distal end of a first engagement arm formed on the second slide member; a slider retaining portion for preventing the withdrawal of the slider formed on an inner surface of the slider receiving portion; and a retaining projection for engaging with the slider retaining portion formed on a side of the first slide member; wherein the retaining projection is retained by the slider retaining portion, thereby preventing the slider from being withdrawn from the slider receiving portion, when the slider is mounted in the slider receiving portion.

In the connector fitting structure of the above construction, when the slider is mounted in the slider receiving portion, the retaining projection, formed on the first slide member, is retained by the slider retaining portion. At this time, the first slide member is urged by the resilient member, and therefore the retaining projection is held against the slider retaining portion, so that the production of noises and the withdrawal of the slider from the slider receiving portion can be prevented.

DETAILED DESCRIPTION OF THE PREFERRED EMBODIMENTS

Figure 1:
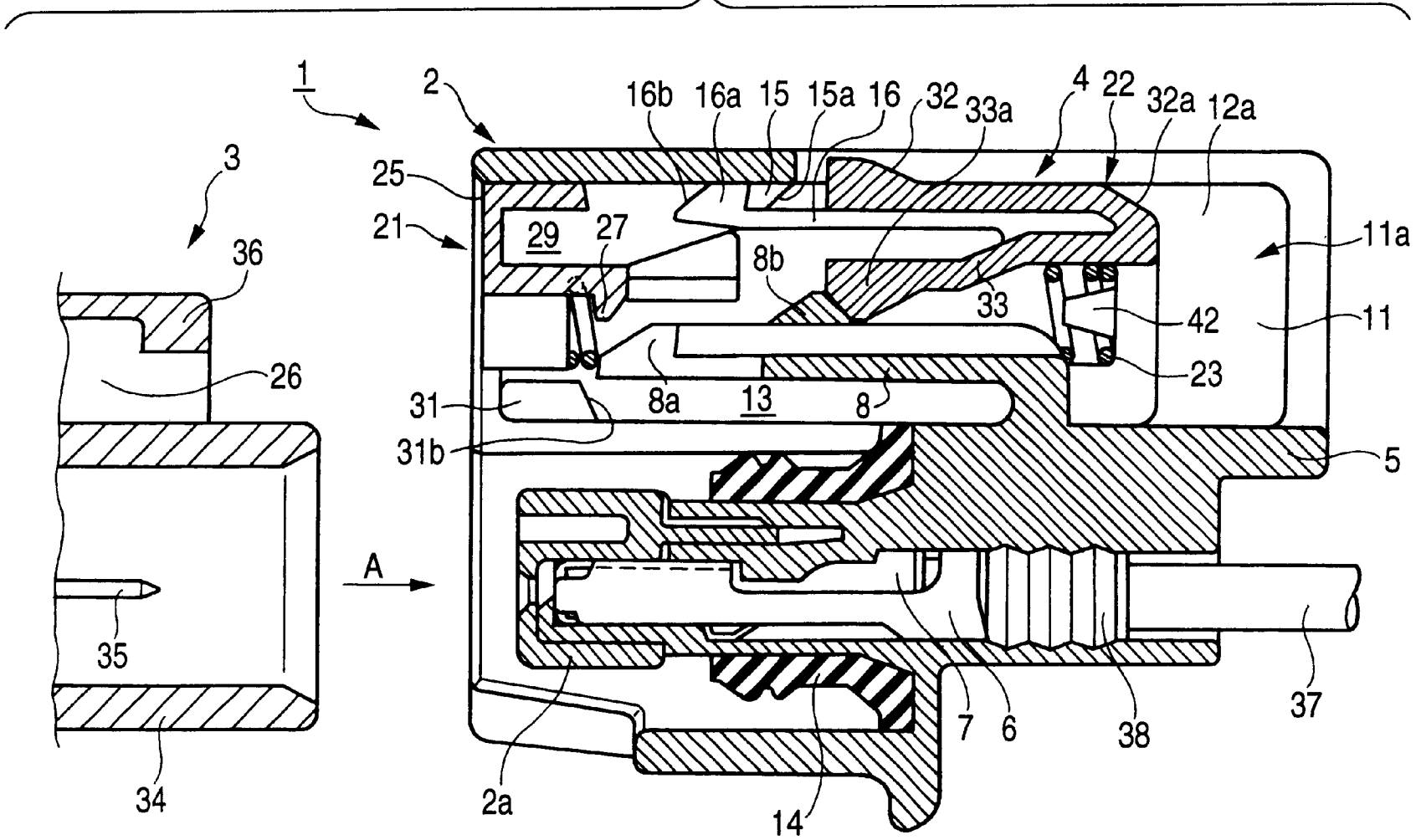
FIG. 1 is a cross-sectional view showing one preferred embodiment of a connector fitting structure of the present invention.
Figure 4:
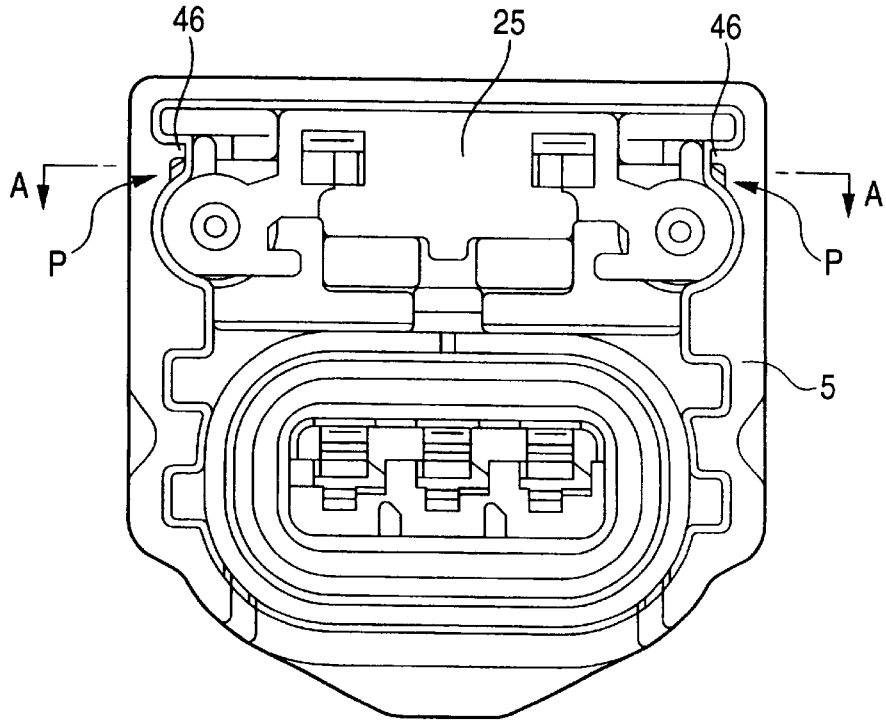
FIG. 4 is a front-elevational view of the male connector of FIG. 3.
Figure 5:
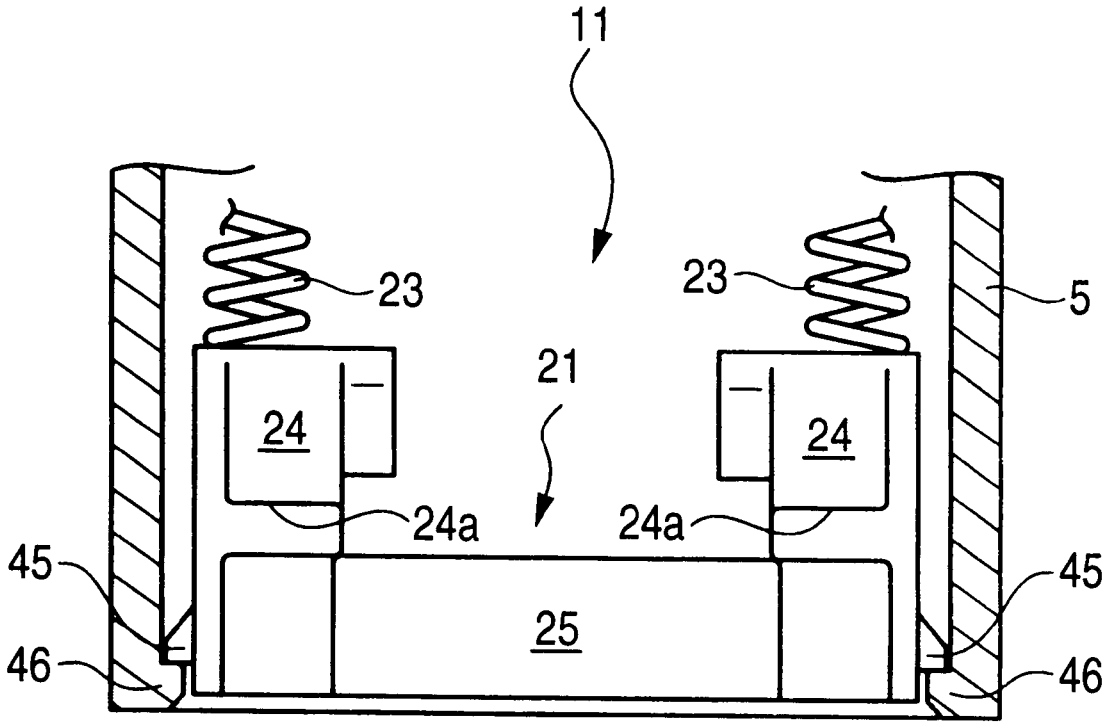
FIG. 5 +is a cross-sectional view taken along the line A—A of FIG. 4.
Figure 6:
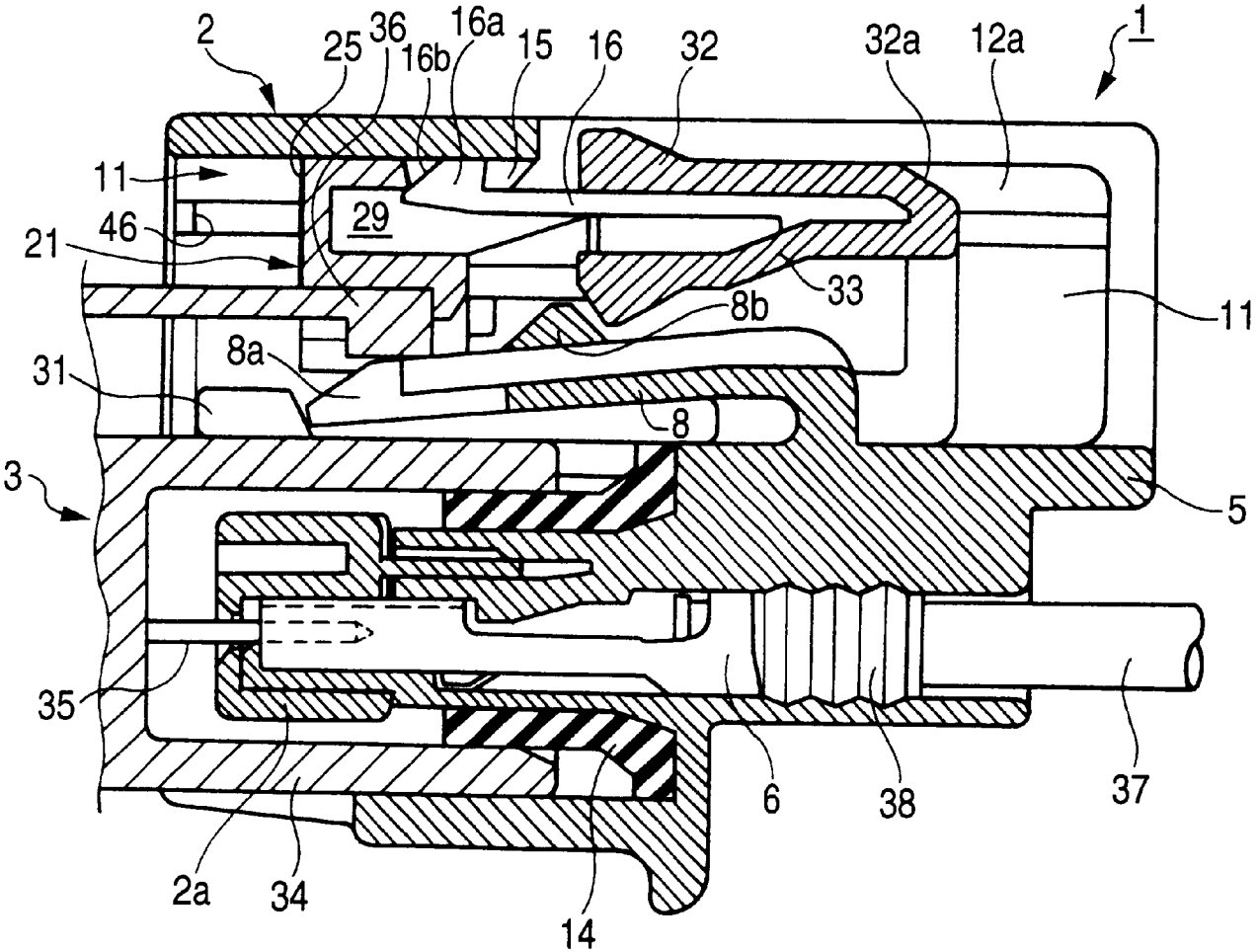
FIG. 6 is a cross-sectional view showing a condition in which the fitting of the male and female connectors of FIG. 1 relative to each other is started.
Figure 7:
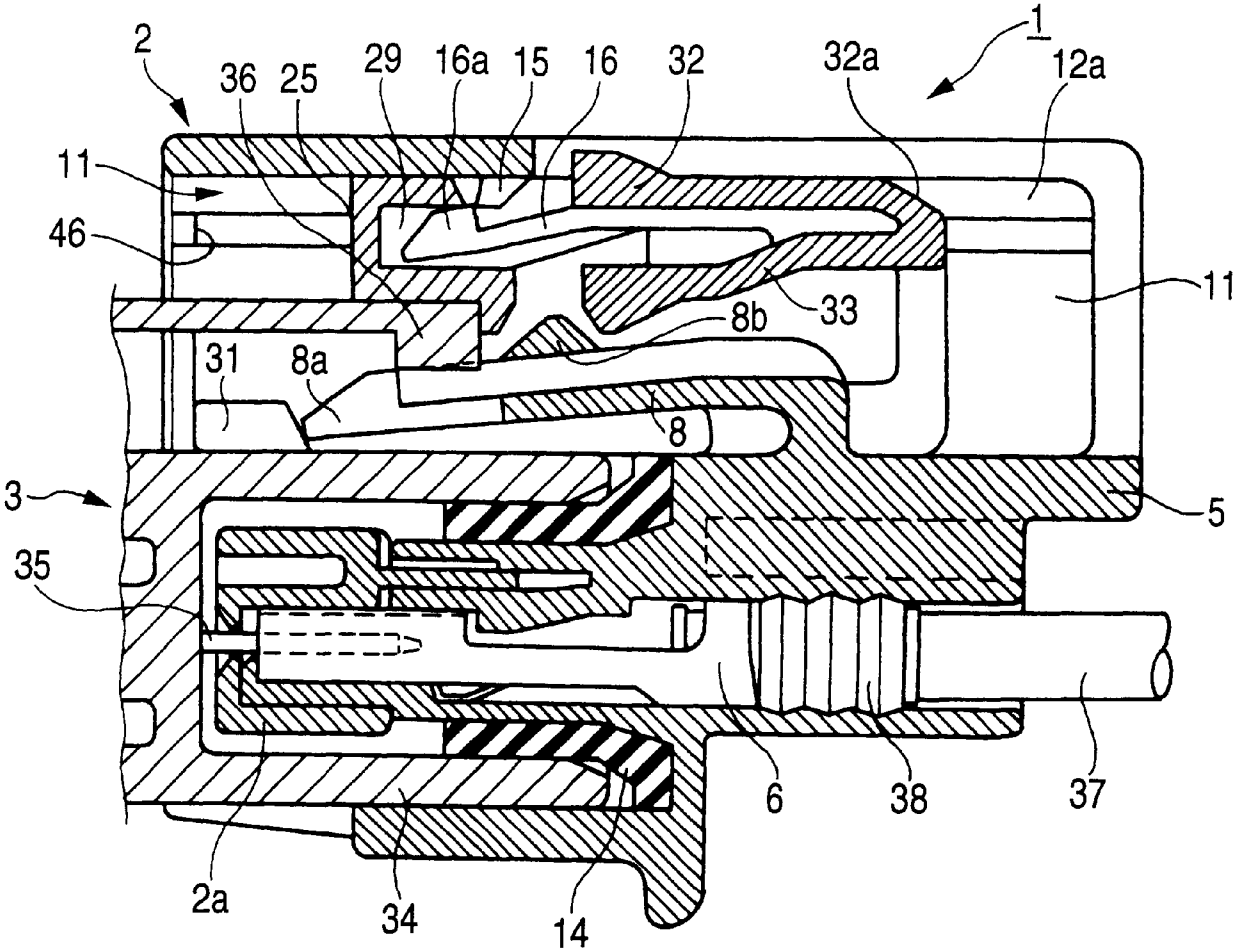
FIG. 7 is a cross-sectional view showing a half-fitted condition of the male and female connectors of FIG. 6.
Figure 8:
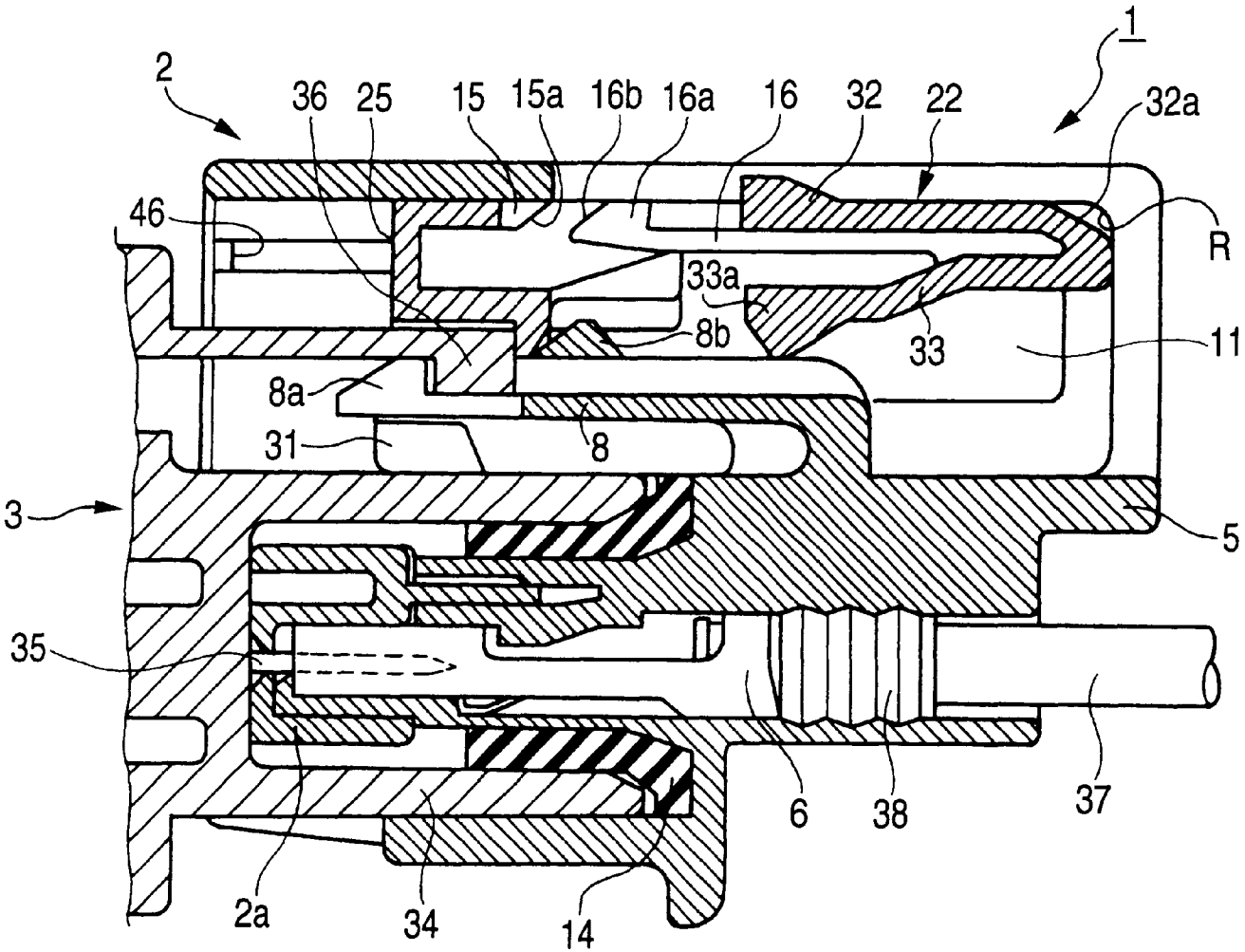
FIG. 8 is a cross-sectional showing a completely-fitted condition of the male and female connectors of FIG. 7.
Figure 9:
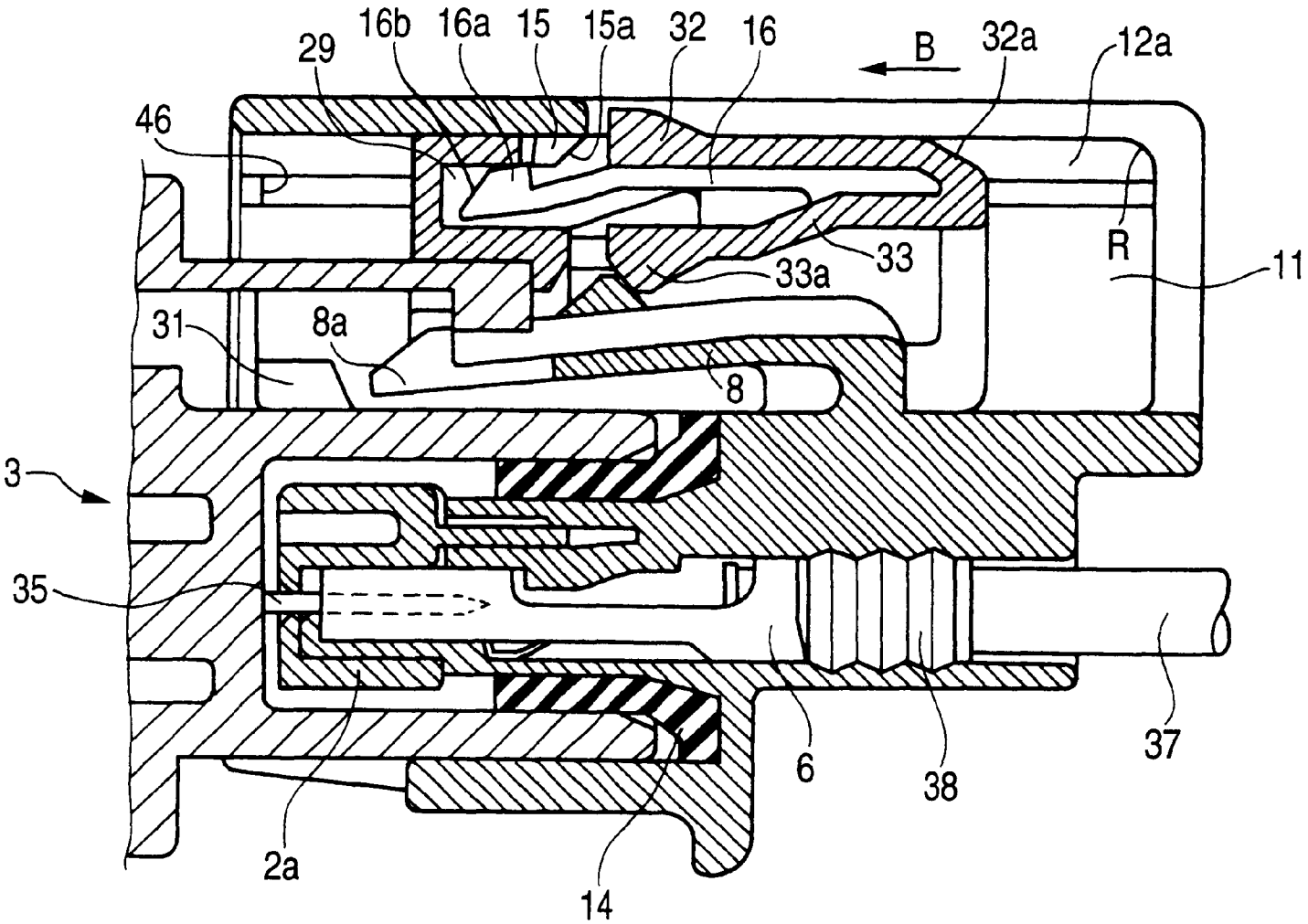
FIG. 9 is a cross-sectional view showing a process of canceling the fitted condition of the male and female connectors of FIG. 8.
Figure 10:
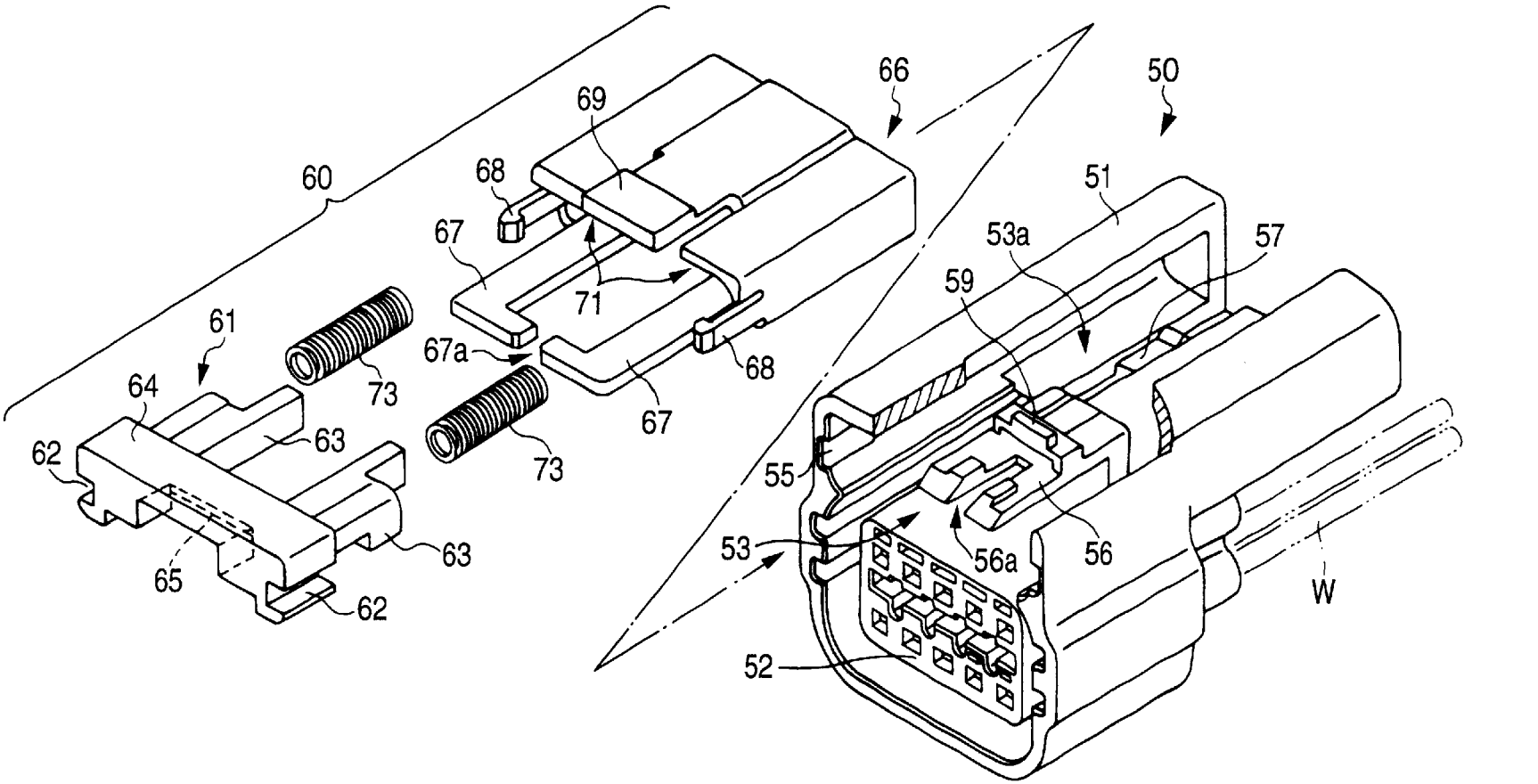
FIG. 10 PRIOR ART
FIG. 10 is an exploded, perspective view showing the construction of a conventional connector fitting structure.
Figure 11:
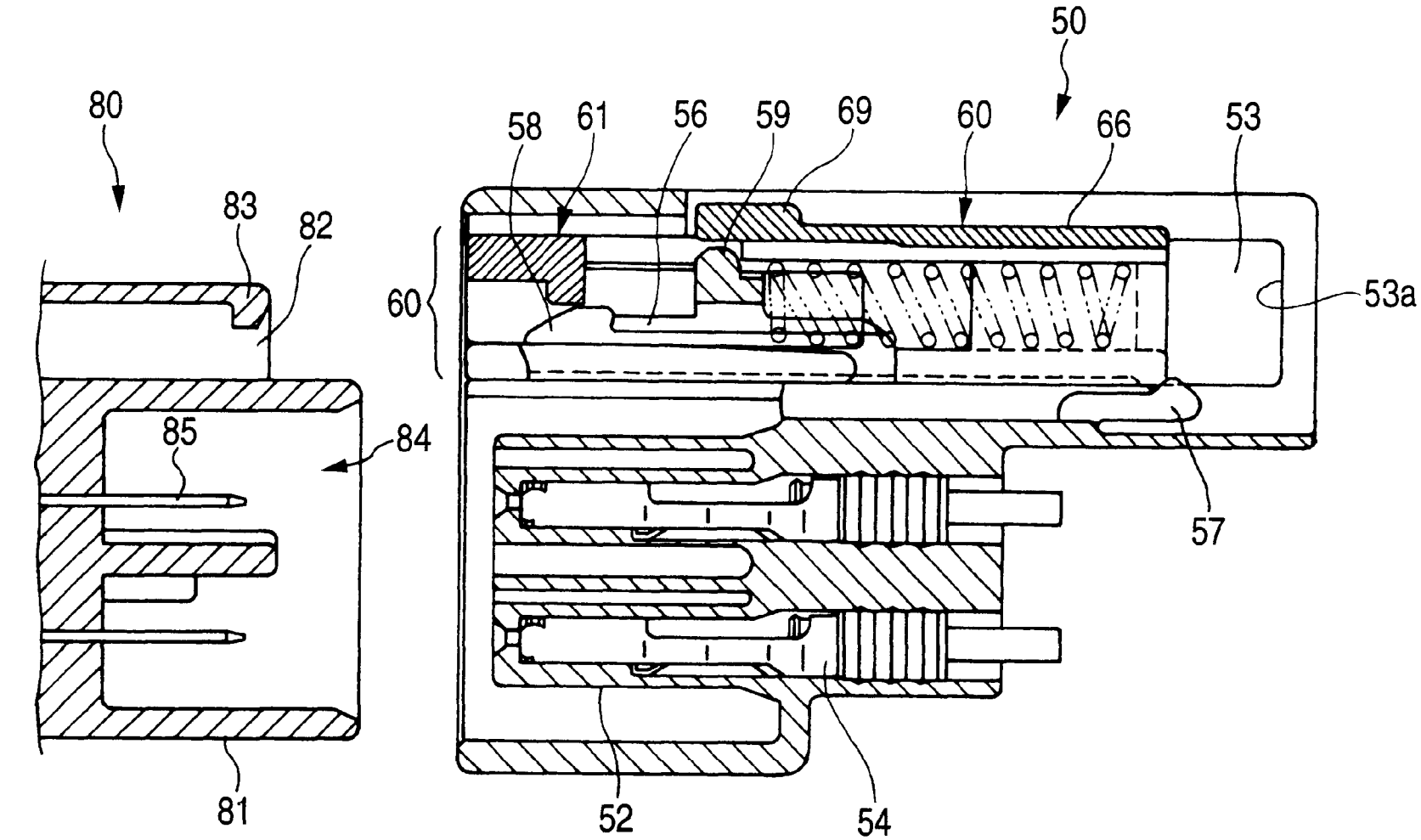
FIG. 11 PRIOR ART
FIG. 11 is a cross-sectional view showing a condition before male and female connectors of FIG. 10 are fitted together.
Figure 12:
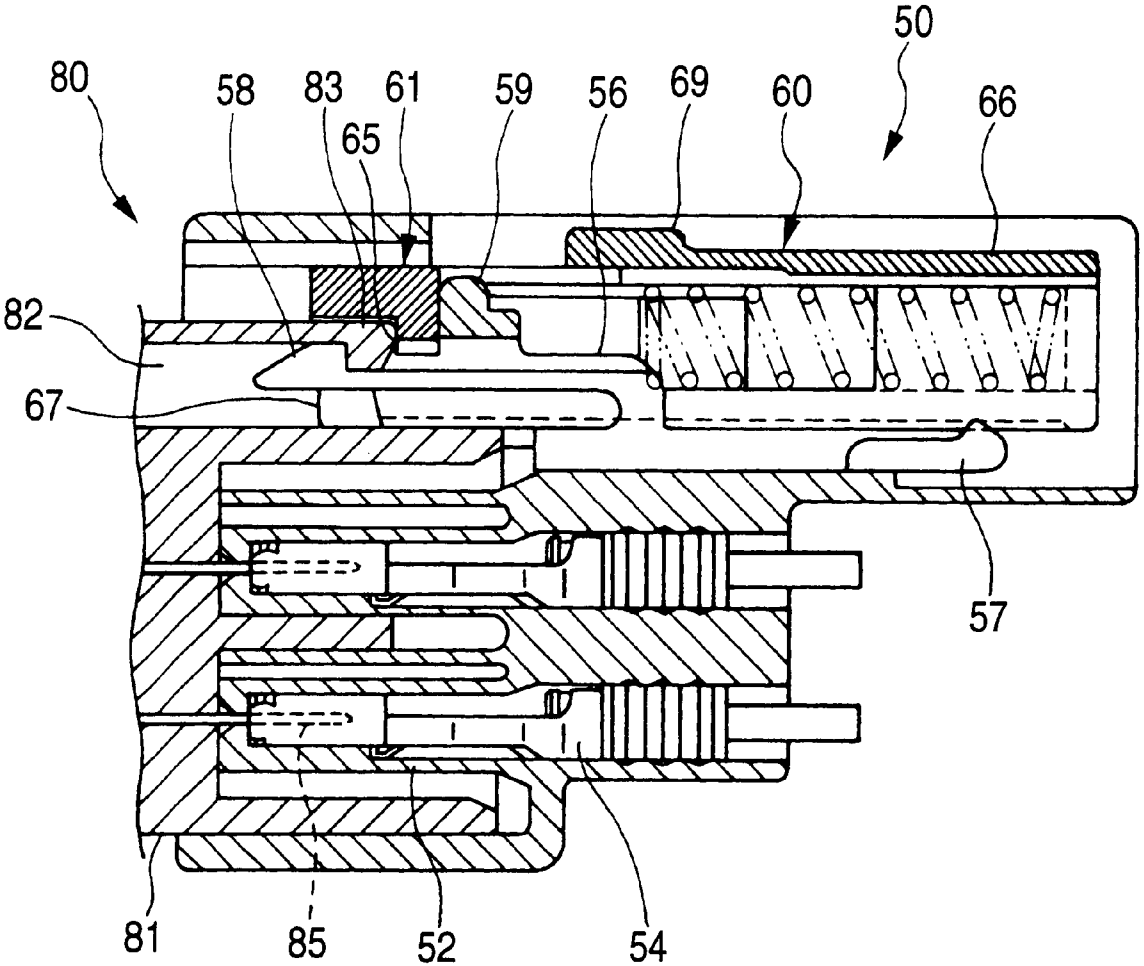
FIG. 12 PRIOR ART
FIG. 12 is a cross-sectional showing a completely-fitted condition of the male and female connectors of FIG. 11.
Figure 13:
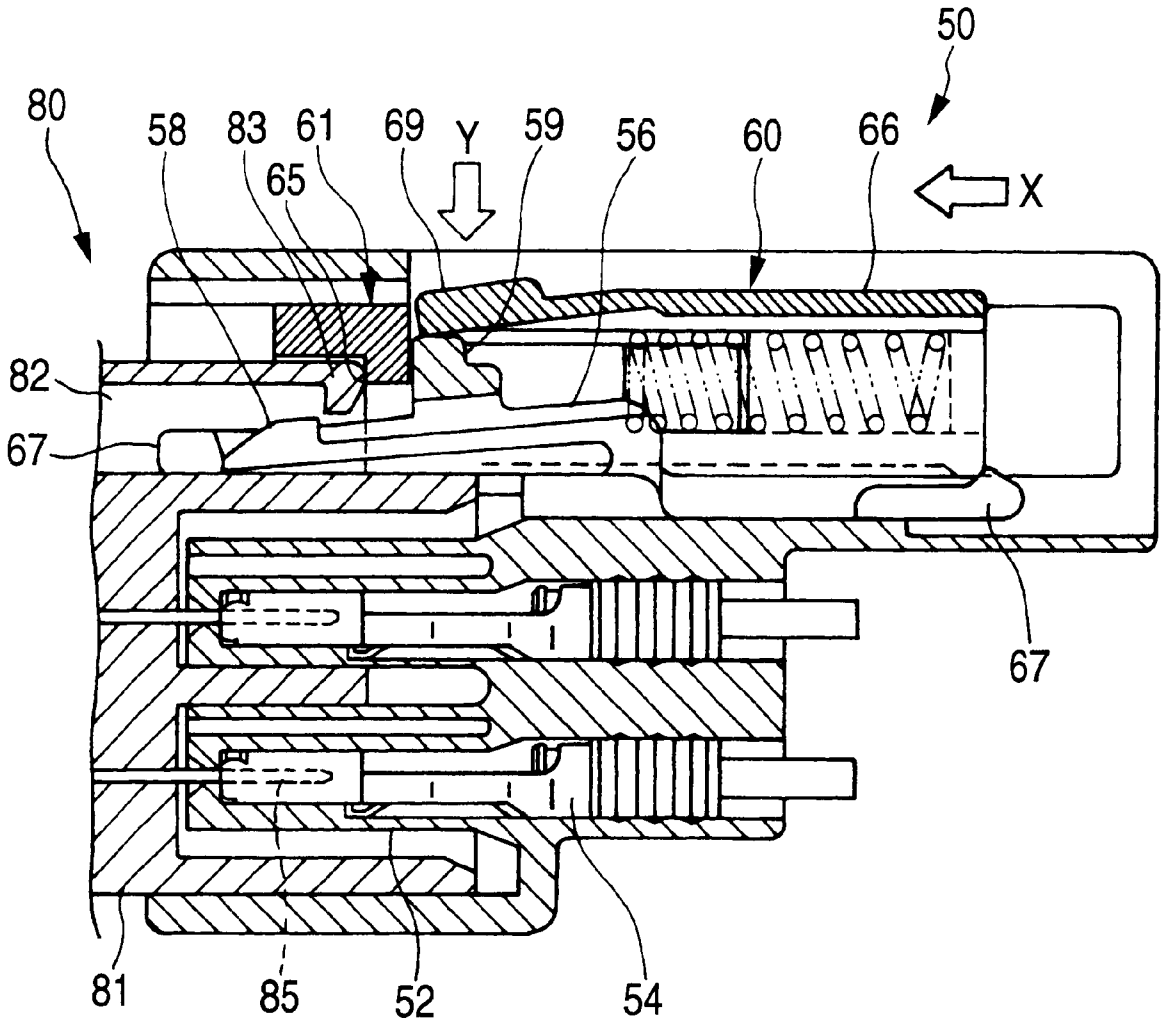
FIG. 13 PRIOR ART
FIG. 13 is a cross-sectional view showing a process of canceling the fitted condition of the. male and female connectors of FIG. 12.

One preferred embodiment of a connector fitting structure of the present invention will now be described in detail with reference to FIGS. 1 to 9. FIG. 1 is a cross-sectional view of male and female connectors, showing the construction of the connecting fitting structure of this embodiment, FIG. 2 is an exploded, perspective view showing the construction of a slider of FIG. 1, FIG. 3 is a perspective view of the male connector of FIG. 1, FIG. 4 is a front-elevational view of the male connector of FIG. 1, FIG. 5 is a cross-sectional view taken along the line A—A of FIG. 4, showing a retained condition of the slider, FIG. 6 is a cross-sectional view showing a condition in which the fitting of the male and female connectors of FIG. 1 relative to each other is started, FIG. 7 is a cross-sectional view showing a half-fitted condition of the male and female connectors of FIG. 6, FIG. 8 is a cross-sectional showing a completely-fitted condition of the male and female connectors of FIG. 7, and FIG. 9 is a cross-sectional view showing a process of canceling the fitted condition in FIG. 8.

Figure 2:
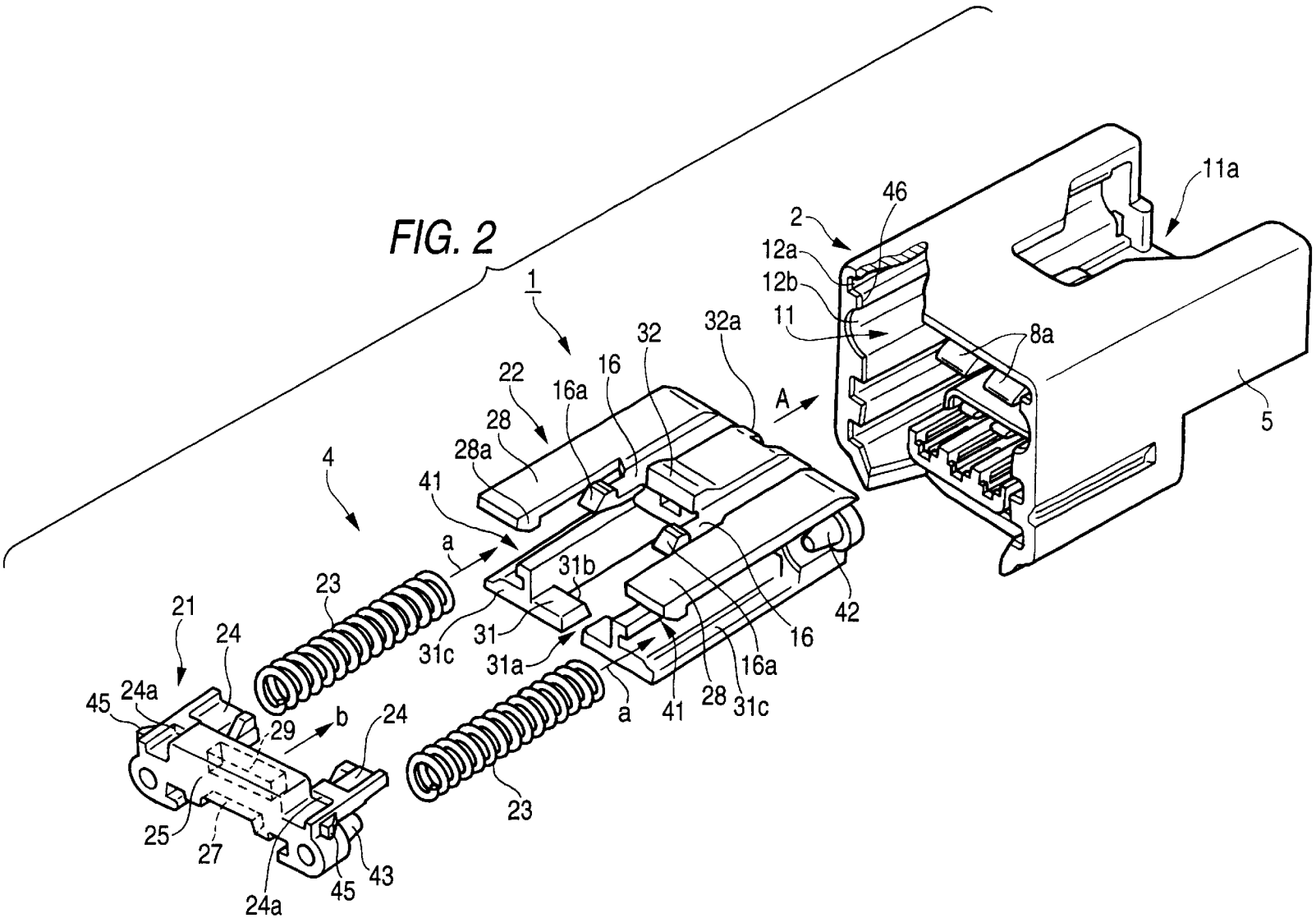
FIG. 2 is an exploded, perspective view showing the construction of a slider of FIG. 1.
Figure 3:
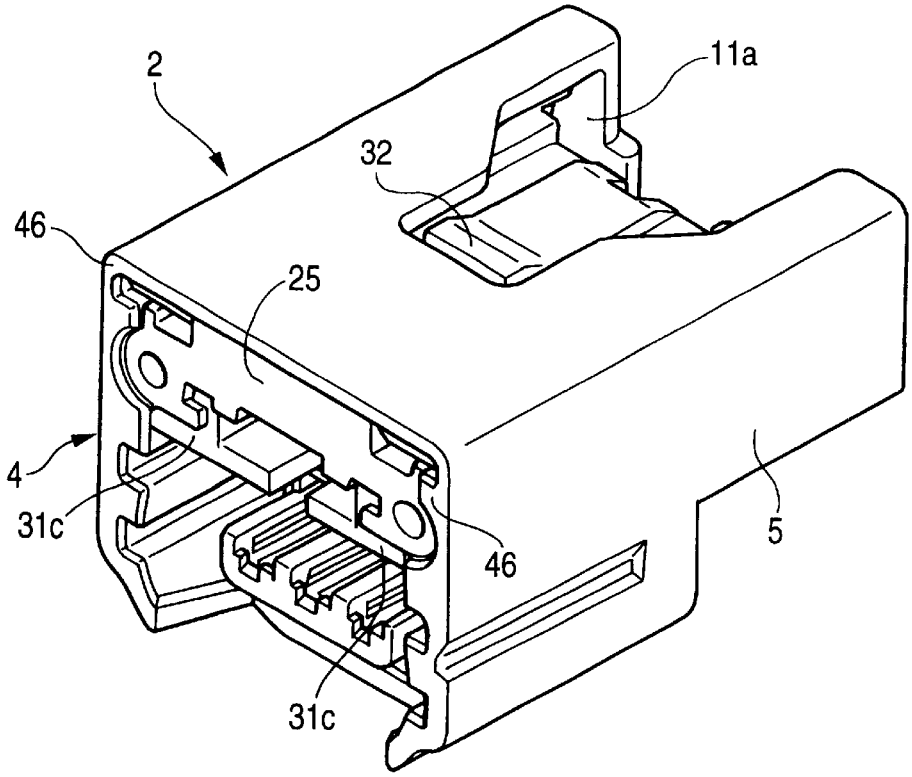
FIG. 3 is a perspective view of the male connector of FIG. 1 having the slider mounted therein.

As shown in FIGS. 1 to 3, the connector fitting structure 1 comprises the male connector (one of the pair of male and female connectors to be fittingly connected together) 2, the female connector (the other connector) 3, the slider 4 (shown in a disassembled condition at a left portion of FIG. 2), and a hood-like outer housing 5 which receives this slider in a manner to allow the same to slide in an axial direction, and can retain the slider at a front end thereof, and covers an inner housing 2*a* (described later).

The male connector 2 includes an inner housing 2*a,* which has terminal receiving chambers 7 for respectively receiving a predetermined number of socket contacts 6, and is open to the front side thereof, the slider 4 (slide lock member) (described later), and the outer housing 5 having the slider 4 slidably mounted therein.

An elastic lock arm 8 of the cantilever type is formed on the inner housing 2*a* along an axis in a fitting direction, and hook-like housing locks 8*a* are formed on a distal end of this lock arm, and a pressing portion 8*b,* which is operated when canceling the fitted condition, is formed on a generally central portion of an upper surface of the lock arm.

A slider receiving portion 11 for receiving the slider 4 is formed between the upper surface of the inner housing 2*a* and an inner surface of an upper wall of the outer housing 5. Two pairs of elongate upper and lower guide grooves 12*a* and 12*b* for respectively guiding opposite side portions of the slider 4 are formed respectively in inner surfaces of opposite side walls of the outer housing.

A side space 11*a* for receiving the slider 4 is formed between the lock arm 8 and the inner surface of the outer housing 5. A first retaining portion 15 is formed on and projects downwardly from the inner surface of the upper wall of the outer housing 5. These first retaining portion 15 is engageable with first engagement arms 16 of the slider 4 (described later), respectively. An insertion space 13 is formed at the lower side of the lock arm 8 and at the lower side of the housing locks 8*a*, and a seal member 14 is fitted on the outer periphery of the inner housing 2*a*.

Next, the construction of the slider 4 will be described.

As shown in FIG. 2, the slider 4 comprises a first slide member 21 for sliding movement in the axial direction within the outer housing 5, a second slide member 22 engaged with a rear portion of the first slide member 21, and a pair of compression springs (resilient members) 23 which are retained in the second slide member 22 in an assembled condition of the slider, and urges the first and second slide members 21 and 22 away from each other by its resilient force.

The first slide member 21 includes a pair of rearwardly-extending stopper arms 24 for engagement with one ends of the respective compression springs 23, and an interconnecting portion 25 interconnecting these stopper arms 24 at their front ends. An abutment portion 27 is formed at a lower surface of a front portion of the interconnecting portion 25, and a pressing rib 26 (see FIG. 1), formed on the female connector 3 (described later), can abut against this abutment portion. An auxiliary retaining surface 24*a* for retaining an auxiliary retaining arm 28 (described later) is formed on an upper surface of each stopper arm 24.

A pair of retaining projections 45 and 45 are formed respectively on outer sides of the pair of stopper arms 24 and 24.

When fitting the male and female connectors together, the first and second slide members 21 and 22 approach each other, and a slide groove 29 is formed in the rear surface of the interconnecting portion 25, and this slide groove 29 receives second retaining portions 16*a*, formed respectively at the distal ends of the first engagement arms 16 (described later), during the above approaching operation.

The second slide member 22 has forwardly-extending retaining portions 31 which are formed at a lower portion of the front end thereof so as to prevent the downward displacement of the housing locks 8*a*. An operating portion 32, which is operated when canceling the fitted condition, is formed at a generally central portion of the upper surface of the second slide member 22. A second engagement arm 33 of an elastic nature is formed beneath the operating portion 32. When mounting the slider 4 in the outer housing 5, this second engagement arm 33 engages the pressing portion 8*b* to prevent the withdrawal of the slider 4. An engagement projection 33*a* is formed on a lower surface of this second engagement arm 33 at a distal end thereof.

A passage notch 31*a* is formed between the pair of retaining portions 31 and 31 so that the pressing rib 26, formed on the female connector 3, will not interfere with the second slide member 22 when fitting the male and female connectors 2 and 3 together. A slanting surface 31*b* of a predetermined angle is formed at an inner end of each of the two retaining portions 31 and 31, as shown in FIG. 1.

As shown in FIG. 2, thickened sliding-contact ribs 31*c* are formed respectively at outer sides (spaced from each other in a widthwise direction) of the pair of retaining portions 31 and 31, that is, at outer sides of fitting grooves 41 for respectively receiving the compression springs 23, and these sliding-contact ribs 31*c* can be disposed in sliding contact with the inner surface of the outer housing 5 within the side space 11*a* for inserting the slider 4.

The auxiliary retaining arms 28 and 28 of an elastic nature are formed on the second slide member 22, and an auxiliary retaining projection 28*a* for retaining engagement with the corresponding auxiliary retaining surface 24*a* of the first side member 21 is formed on a lower surface of each auxiliary retaining arm 28 at a front end thereof.

As shown in FIG. 1, pin contacts 35 project into the interior of a housing 34 of the female connector (the other connector) 3 in the fitting direction (that is, in the direction of arrow A), and the pressing rib 26 for abutting engagement with the abutment portion 27 of the first slide member 21 is formed on a widthwise-central portion of an upper surface of the housing 34, and extends in the fitting direction.

A pair of engagement projections 36 are formed respectively on opposite sides of the pressing rib 26 at a front end thereof, and these engagement projections 36 elastically deform the lock arm 8, and are engaged respectively with the housing locks 8*a* when the male and female connectors 2 and 3 are fitted together.

Next, the assembling of the slider 4 will be described.

For assembling the slider 4, the compression springs 23 are inserted respectively into the fitting grooves 41, formed respectively in the opposite side portions of the second slide member 22, in a direction of arrow a in FIG. 2, and one ends of these compression springs 23 are brought respectively into fitting engagement with engaging projections 42 formed respectively at rear ends of the fitting grooves 41. In this condition, the first slide member 21 is moved toward the open end of the second slide member 22 in a direction of arrow b, and the other ends of the compression springs 23 are fitted respectively on engaging projections 43. Then, the first slide member 21 is further moved toward the second slide member, and is inserted thereinto in such a manner that the first slide member 21 is generally interposed between each fitting groove 41 and the auxiliary retaining arm 28. At this time, each auxiliary retaining arm 28 is elastically deformed upwardly, and then is elastically restored into its initial configuration upon retaining engagement of its auxiliary retaining projection 28*a* with the corresponding auxiliary retaining surface 24*a*. As a result, the first and second slide members 21 and 22 and the compression springs 23 are combined together in a generally unitary manner, thus completing the assembling of the slider 4.

Next, the mounting of the slider 4 in the male connector 2 will be described.

The slider 4 is inserted into the slider receiving portion 11, formed in the upper portion of the male connector 2, in a direction of arrow A shown in FIG. 2. In this inserting operation, the operating portion 32 is brought into contact with the inner surface of the upper wall of the outer housing 5 (on which the first retaining portion 15, shown in FIG. 1, is formed) to be deformed downwardly, and moves in sliding contact therewith, and reaches the side space 11*a*, formed at the rear end portion, whereupon this operating portion 32 is elastically restored into its initial configuration.

Whether or not the slider 4 has been properly inserted (that is, the slider has been properly mounted) can be confirmed from the restoration of the operating portion 32 into its initial configuration. When the slider 4 is slidably mounted in the slider receiving portion 11, the whole of the slider 4 is received in the outer housing 5 of the male connector 2 as shown in FIG. 3, and the interconnecting portion 25 and so on are exposed to the front end of the male connector 2 while the operating portion 32 and so on are exposed through a rear opening in the outer housing 5.

At this time, sliding-contact ribs 31*c* of the second slide member 22 are brought into abutment with the inner surfaces of the outer housing 5 in a slidable state, and reliably prevent the first slide member 21 from being interposed between the outer housing 5 and the second slide member 22 during the fitting operation of the male and female connectors 2 and 3.

In this embodiment, when the slider 4 is mounted in the male connector 2, the following retaining, which is to be noted, is effected. Namely, as shown in FIG. 2, the retaining projections 45 are formed on the first slide member 21, and a pair of slider retaining portions 46 and 46 are formed at the front end portion of the slider receiving portion 11 as shown in a partly-broken portion of FIG. 1.

Therefore, when mounting the slider 4 in the male connector 2, the pair of retaining projections 45 and 45 are brought into abutting engagement with the pair of slider retaining portions 46 and 46, respectively, whereupon the resistance temporarily increases. Then, when the slider 4 is further pushed into the male connector 2, the pair of retaining projections 45 and 45 slide respectively past the pair of slider retaining portions 46 and 46 because of elastic deformation of the housing 5 and so on.

As a result, as shown in FIG. 4, the pair of retaining projections 45 and 45 are retained respectively by the pair of slider retaining portions 46 and 46 at positions P disposed respectively at the opposite side portions of the housing 5, and a feeling of click is obtained when this sliding-past action is effected. Therefore, the fact that slider 4 has been positively mounted in the male connector 2 can be recognized through the restoration of the operating portion 32 into its initial configuration and this click feeling.

The internal structure of the male connector 2 is such that the second retaining portions 16*a,* formed respectively at the distal ends of the first engagement arms 16, are engaged with the first retaining portion 15, as shown in FIG. 1. Therefore, in this condition, the whole of the slider 4 will not move in a right-hand direction in the drawings. The engagement projection 33*a,* formed at the distal end of the second engagement arm 33, has slid past the pressing portion 8*b* formed on the generally central portion of the upper surface of the lock arm 8.

The compression springs 23 resiliently support the first slide member 21 in such a manner that one end portion of the second slide member 22, at which the engaging projections 42 are formed, serves as a supporting point for these compression springs 23.

Therefore, the first slide member 21 can be moved in the right-hand direction (in the drawings) against the bias of the compression springs 23.

However, the amount of resilient movement of the slider in the axial direction by the urging of the first slide member 21 is small since the auxiliary retaining projections 28*a* are disposed in retaining engagement with the auxiliary retaining surfaces 24*a,* respectively.

In this embodiment, the pair of retaining projections 45 and 45 are retained by the pair of slider retaining portions 46 and 46, respectively, and with this arrangement, when the first slide member 21 is urged by the resilient force of the compression springs 23, the pair of retaining projections 45 and 45 are pressed against the pair of slider retaining portions 46 and 46, respectively, and therefore a clearance is not formed therebetween, so that the production of noises due to rattling and so on can be prevented.

Next, the operation for fitting the male and female connectors 2 and 3 together will be described.

The female connector 3 is fitted into the male connector 2 in the direction of arrow A (shown in FIG. 1), and when the female connector 3 is thus inserted into the male connector 2, the engagement projections 36 abut against the abutment portion 27.

Then, when the female connector 3 is further inserted as shown in FIG. 6, only the first slide member 21 is pushed into the slider receiving portion 11 since the first slide member 21 is resiliently supported by the compression springs 23. As a result, the engagement projections 36 slide respectively over slanting surfaces, formed respectively at the front ends of the housing locks 8*a,* and elastically deform the whole of the lock arm 8 in accordance with the amount of insertion of the female connector 3. The pin contacts 35 are inserted respectively into the socket contacts 6.

When the female connector 3 is further inserted into the male connector 2 in the condition shown in FIG. 6, the upper end of the interconnecting portion 25 slides over slanting surfaces of the second retaining portions 16*a* in accordance with the amount of this insertion, as shown in FIG. 7. As a result, the second retaining portions 16a are introduced into the slide groove 29, and the first engagement arms 16 are elastically deformed in a forwardly downwardly-slanting manner, so that each second retaining portion 16*a* is disengaged from the first retaining portion 15.

At this time, the engagement projections 36 are about to slide past the housing locks 8*a,* respectively. The pin contacts 35 are inserted deeper into the socket contacts 6, respectively.

Then, when the female connector 3 is further inserted into the male connector 2 in the condition shown in FIG. 7, the engagement projections 36 slide past the housing locks 8*a,* respectively. As a result, the lock arm 8 is restored into its initial configuration because of its own elastic nature, so that the engagement projections 36 are engaged with the housing locks 8*a,* respectively. The engagement of the first retaining portion 15 with the second retaining portions 16*a* is completely canceled, and therefore the whole of the slider 4 is pushed toward the rear end of the slider receiving portion 11 by the resilient force of the compression springs 23.

The male and female connectors 2 and 3 are completely fitted together as shown in FIG. 8, and the male and female connectors 2 and 3 can not be withdrawn from each other because of the engagement of each engagement projection 36 with the housing lock 8*a*. The pin contacts 35 are fitted respectively in the socket contacts 6 to be electrically connected thereto. The housing 34 of the female connector 3 is held against the seal member 14, and therefore the male and female connectors 2 and 3 are completely fitted together in a watertight manner, and are held against withdrawal.

A wire 37 is clamped to the socket contact 6, and a waterproof member 38 is interposed between the wire 37 and the relevant portion of the outer housing 5. Therefore, the intrusion of water along the wire 37 is positively prevented by the waterproof member 38.

As described above, when the male and female connectors 2 and 3 are completely fitted together, the second slide member 22 of the slider 4 is resiliently pressed against the wall of the slider receiving portion 11 by the resilient force of the compression springs 23 supported by the first slide member 21 serving as the supporting point, as shown in FIG. 8.

The upper end of the slider receiving portion 11 is formed into a curved surface R for the purposes of facilitating the removal from a mold and for increasing the strength. Therefore, if an upper end 32*a* of the proximal end of the operating portion 32 is formed into an angular shape, the upper end 32*a* would strike hard against the curved surface R, which would lead to a possibility that one or both of them is subjected to cracking or chipping. It is difficult to detect such cracking and chipping during the production process.

Therefore, in this embodiment, the upper end is formed into a tapering (slanting) surface 32*a* so that it will not abut against the curved surface R. With this construction, when the second slide member 22 is moved toward the rear end by the resilient force of the compression springs 23, cracking and chipping will not develop in either of the operating portion 32 and the curved surface R, and the reliability of the male and female connectors 2 and 3 is enhanced.

Next, the operation for canceling the fitted condition of the male and female connectors 2 and 3 will be described.

For canceling the fitted condition of the male and female connectors 2 and 3, the operating portion 32 is pushed to be moved in a direction of arrow B as shown in FIG. 9. As a result, the second retaining portion 16*a,* formed at the distal end of each first engagement arm 16, is moved from the position shown in FIG. 8, and slides past the first retaining portion 15, as shown in FIG. 9.

At this time, the slanting surface 16*b* of each second retaining portion 16*a* slides downward along a slanting surface 15*a* of the first retaining portion 15, and therefore merely by pulling the operating portion 32 in the direction of arrow B, the second retaining portion 16*a* slides past the first retaining portion 15. Thus, the slanting surfaces 15*a* and 16*b* have the guide function, and the operation in the direction Y as described above for the conventional construction is not necessary, and therefore the operability is enhanced.

At the time when each second retaining portion 16*a* completely slides past the first retaining portion 15, the first slide member 21 is pushed by the resilient force of the compression springs 23, and therefore the cancellation of the fitted condition can be effected smoothly. At the time when each second retaining portion 16*a* thus completely slides past the first retaining portion 15, the front end of the operating portion 32 abuts against the rear end of the first retaining portion 15, so that the movement of this operating portion in the direction of arrow B is prevented. Therefore, when canceling the fitted condition, the cancellation of the fitted condition can be detected through this abutment, and therefore the operability for the fitting-cancellation operation can be enhanced.

As described above, in the connector fitting structure of this embodiment, when the slider is mounted in the housing, the pair of retaining projections 45 and 45, formed on the first slide member, are retained respectively by the slider retaining portions 46 and 46 formed on the housing 5, and therefore a clearance is not formed between the slider 4 and the housing 5, so that the production of noises and so on can be prevented.

As described above, in the connector fitting structure of the present invention, the slanting surface is formed on the second retaining portion formed at the end of each of first engagement arms formed on the second slide member, and the first retaining portion is formed at the end of the inner surface facing the slider receiving portion, and the engagement of the first retaining portion with the second retaining portions is canceled at the time of fitting the male and female connectors together, and the first retaining portion is engaged with the second retaining portions at the time of canceling the fitted condition, and the slanting surface is formed on the first retaining portion, and at the time of canceling the fitted condition, the second slide member is operated in one direction, thereby smoothly engaging the first retaining portion with the second retaining portions.

Therefore, at the time of canceling the fitted condition of the male and female connectors, by operating the operating portion, formed integrally with the first engagement arms, the second retaining portion, formed at the end of each first engagement arm of the slider, slides over the first retaining portion, formed at the one end of the inner surface facing the slider receiving portion, and is engaged with this first retaining portion. The slanting surfaces are formed respectively on those portions of the first and second retaining portions which can be brought into sliding contact with each other at this time, and therefore by operating the operating portion in the one direction, the second retaining portion can easily slide past the first retaining portion to be engaged therewith. Besides, it is not necessary to press the operating portion at the time of this sliding-past action, and therefore the operability for the fitting-cancellation operation is greatly enhanced.

In the connector fitting structure of the invention, the second slide member includes the operating portion for sliding the whole of the second slide member in the slider receiving portion at the time of canceling the fitted condition, and the first engagement arms formed integrally with the operating portion, and when the second retaining portions, formed respectively at the distal ends of the first engagement arms, are engaged with the first retaining portion, formed at one end of the inner surface facing the slider receiving portion, at the time of canceling the fitted condition of the male and female connectors, the operating portion is abutted against the end of the first retaining portion, thereby detecting the engaged condition.

Therefore, at the time of canceling the fitted condition of the male and female connectors, the one end of the operating portion for sliding the second slide member abuts against the end of the first retaining portion formed at the one end of the inner surface facing the slider receiving portion, and the cancellation of the fitted condition can be detected by whether or not this abutment has occurred, and therefore the operability for the fitting-cancellation operation is greatly enhanced.

In the connector fitting structure of the invention, an operating portion for sliding the second elide member in the slider receiving portion is formed on the second slide member; and a tapering surface is formed on an upper surface of a rear end of the operating portion, opposed to a rear end of the slider receiving portion at the time of fitting the male and female connectors together, so that an area of contact between the rear end of the operating portion and the rear end of the slider receiving portion at the time of fitting the male and female connectors together is reduced.

Therefore, the operating portion will not abut against the corner portion of the slider receiving portion over the entire area thereof, thereby preventing cracking and chipping, and the reliability of the connector, as well as the reliability of an equipment, employing the connector, can be enhanced.

As described above, in the connector fitting structure of the present invention, the slider retaining portions for preventing the withdrawal of the slider is formed on the inner surface of the slider receiving portion, and the retaining projections for retaining engagement with the respective slider retaining portions are formed respectively on the side portions of the first slide member, and when the slider is mounted in the slider receiving portion, the retaining projections are retained respectively by the slider retaining portions, thereby preventing the slider from being withdrawn from the slider receiving portion. Therefore, when the slider is mounted in the slider receiving portion formed in the housing, the retaining projections, formed on the first slide member, are retained by the slider retaining portions, and the first slide member is urged by the compression springs, and therefore the retaining projections are pressed respectively against the slider retaining portions, so that the production of noises and the withdrawal of the slider from the slider receiving portion can be positively prevented.

Guide grooves 12 for respectively guiding opposite side portions of the slider 4 are formed respectively in inner surfaces of opposite side walls of the outer housing.

What is claimed is:

1. A connector fitting structure comprising:

a first connector having an inner housing opening to a front side thereof including a lock arm, and an outer housing covering said inner housing and provided with a slider receiving portion for slidably receiving a slider therein;

said slider including a first slide member for reciprocally sliding within said first connector in a connector fitting direction, a second slide member engaged with a rear portion of said first slide member, and an resilient member for urging said first and second slide members away from each other;

a second connector fitted to said first connector and having an engagement projection for abutment against one end of said slider and for deforming said lock arm;

a first retaining portion projecting downwardly from an inner surface of said outer housing; and a second retaining portion provided at a distal end of a first engagement arm formed on said second slide member;

wherein said first and second retaining portions are engaged with each other before fitting of said first and second connectors and after canceling the fitted state of said first and second connectors, and disengaged from each other at the time of fitting of said first and second connectors, and wherein slanting surfaces are provided both on said first and second retaining portions, so that said second retaining portion smoothly engages with said first retaining portion by a sliding movement of said second sliding member in one direction, when the fitted condition of said first and second connectors is cancelled.

2. A connector fitting structure comprising:

a first connector having an inner housing opening to a front side thereof including a lock arm, and an outer housing covering said inner housing and provided with a slider receiving portion for slidably receiving a slider therein;

said slider including a first slide member for reciprocally sliding within said first connector in a connector fitting direction, a second slide member engaged with a rear portion of said first slide member, and an resilient member for urging said first and second slide members away from each other;

a second connector fitted to said first connector and having an engagement projection for abutment against one end of said slider and for deforming said lock arm;

a first retaining portion projecting downwardly from an inner surface of said outer housing;

a second retaining portion provided at a distal end of a first engagement arm formed on said second slide member; and an operating portion integrally formed on said first engagement arm for operating to slide said second slide member in said slider receiving portion at the time of canceling the fitted state of said first and second connectors;

wherein said first and second retaining portions are engaged with each other before fitting of said first and second connectors and after canceling the fitted state of said first and second connectors, and disengaged from each other at the time of fitting of said first and second connectors, and wherein said operating portion is abutted against an end of said first retaining portion, thereby detecting the engagement between said first and second retaining portions at the time of canceling the fitted state of said first and second connectors.

3. A connector fitting structure comprising:

a first connector having an inner housing opening to a front side thereof including a lock arm, and an outer housing covering said inner housing and provided with a slider receiving portion for slidably receiving a slider therein;

said slider including a first slide member for reciprocally sliding within said first connector in a connector fitting direction, a second slide member engaged with a rear portion of said first slide member, and an resilient member for urging said first and second slide members away from each other;

a second connector fitted to said first connector and having an engagement projection for abutment against one end of said slider and for deforming said lock arm;

a first retaining portion projecting downwardly from an inner surface of said outer housing;

a second retaining portion provided at a distal end of a first engagement arm formed on said second slide member; and an operating portion integrally formed on said first engagement arm for operating to slide said second slide member in said slider receiving portion at the time of canceling the fitted state of said first and second connectors;

wherein a tapering surface is formed on an upper surface of said second slide member, facing said slider receiving portion at the time of fitting of said first and second connectors, so that an area of contact between said second slide member and said slider receiving portion at the time of fitting of said first and second connectors is reduced.

4. A connector fitting structure comprising:

a first connector having an inner housing opening to a front side thereof including a lock arm, and an outer housing covering said inner housing and provided with a slider receiving portion for slidably receiving a slider therein;

said slider including a first slide member for reciprocally sliding within said first connector in a connector fitting direction, a second slide member engaged with a rear portion of said first slide member, and an resilient member for urging said first and second slide members away from each other;

a second connector fitted to said first connector and having an engagement projection for abutment against one end of said slider and for deforming said lock arm;

a first retaining portion projecting downwardly from an inner surface of said outer housing;

a second retaining portion provided at a distal end of a first engagement arm formed on said second slide member;

a slider retaining portion for preventing the withdrawal of said slider formed on an inner surface of said slider receiving portion; and a retaining projection for engaging with said slider retaining portion formed on a side of said first slide member;

wherein said retaining projection is retained by said slider retaining portion, thereby preventing said slider from being withdrawn from said slider receiving portion, when said slider is mounted in said slider receiving portion.

5. A connector fitting structure according to claim 4, wherein said retaining projection is pressed against said slider retaining portion by a repulsive force of said resilient member.

* * * * *